US006563123B1

(12) United States Patent
Sellschop et al.

(10) Patent No.: US 6,563,123 B1
(45) Date of Patent: May 13, 2003

(54) METHOD OF PRODUCING CARBON WITH ELECTRICALLY ACTIVE SITES

(75) Inventors: Jacques Pierre Friedrich Sellschop, 60 Greenhill Road, Greenside, 2193 (ZA); Paul Kienle, Munich (DE)

(73) Assignee: Jacques Pierre Friedrich Sellschop, Greenside (ZA)

( * ) Notice: Subject to any disclaimer, the term of this patent is extended or adjusted under 35 U.S.C. 154(b) by 0 days.

(21) Appl. No.: 09/646,359

(22) PCT Filed: Mar. 16, 1999

(86) PCT No.: PCT/IB99/00425

§ 371 (c)(1),
(2), (4) Date: Nov. 27, 2000

(87) PCT Pub. No.: WO99/48107

PCT Pub. Date: Sep. 23, 1999

(30) Foreign Application Priority Data

Mar. 17, 1998 (ZA) ..... 98/2242

(51) Int. Cl.[7] ..... A61N 5/00; G21G 5/00
(52) U.S. Cl. ..... 250/492.1
(58) Field of Search ..... 250/492.1

(56) References Cited

U.S. PATENT DOCUMENTS 2,998,365 A * 8/1961 Custers et al. ..... 204/157
4,749,869 A * 6/1988 Fournier ..... 250/492.1
5,084,909 A * 1/1992 Pollak ..... 250/492.1

FOREIGN PATENT DOCUMENTS

EP 0238206 * 9/1987
EP 0 479 625 A2 10/1991
WO WO/99/67171 * 12/1999

OTHER PUBLICATIONS

Bo Nordell, "Production of $^{11}C$ by Photonuclear Reactions", vol. 35, pp 455–458, (1984).

J. Ahrens, et al. "Total Nuclear Photon Absorption Cross Sections for Some Light Elements", pp. 479–792 (1974).

Michael E. Baginski, et al., Characterization of Ion Implantation and Thermal Annealing of Boron in <100> Diamond, vol. 137, No. 9 (1990).

* cited by examiner

*Primary Examiner*—Bruce Anderson
(74) *Attorney, Agent, or Firm*—Scully, Scott, Murphy & Presser

(57) ABSTRACT

A method of producing carbon with electrically active sites includes the steps of providing a source of carbon and exposing that source to irradiation of an energy suitable to cause the photonuclear transmutation of some of the carbon atoms into boron.

12 Claims, 2 Drawing Sheets

METHOD OF PRODUCING CARBON WITH ELECTRICALLY ACTIVE SITES

BACKGROUND OF THE INVENTION

This invention relates to a method of producing carbon with electrically active sites.

Diamond is well-appreciated as an excellent electrical insulator. However, a rare class of diamond is found in nature, codified as Type IIb, which has p-type semiconducting properties. Research by one of the inventors (Ref. Sellschop J P F et al, Int J of App Rad and Isot. 28(1977)277) demonstrated that this was due to the presence of boron in the diamond.

The importance of diamond as a semiconducting material has long been anticipated, arising from the many unique physical properties of this material that would render diamond as a material of singular importance in electronic applications, including in rugged environments.

That this has not yet been realised is due to the difficulties in getting this type of boron-doped diamond with a sufficiently low density of defects, and intrinsic and irradiation-induced defects and sufficient spatial homogeneity of the dopant throughout the diamond. Type IIb diamonds are extremely rare in nature, but have been produced synthetically both in high pressure, high temperature growth (HPHT), and in chemical vapour deposition (CVD) growth, by the addition of boron to the synthesis mix. These successes are far from ideal, and do not solve the need, since they may be expensive and slow in the HPHT case and hard to control quantitatively in both cases; homogeneity is hard to achieve. Large defect-free crystals are hard to achieve by the HPHT method, and the CVD method (other than in special circumstances, such as using diamond itself as a growth substrate) produces polycrystalline materials.

This has given rise to a strong thrust to achieve doping by the introduction of relevant materials, such as boron, by a technique known as ion implantation. In this manner, p-type doping has been claimed to have been achieved. There are major difficulties inextricably associated with this technique, however, and one of the most serious of these is that of the radiation damage caused by the penetrating boron ion. Another very serious problem is that the characteristic features of the implantation profile are highly inhomogeneous with regard to the overall geometry of the sample, and there is no evident solution to this feature, even if implantations over a range of different energies are made. In regard to the radiation damage, various temperature regimes and sequences have been used in an effort to restore to some degree the integrity of the damaged crystal lattice, to reduce the number of damage sites which would act as traps and to enhance the probability of providing substitutional sites for the dopant ion in the hope that it will then preferentially populate such substitutional sites. Furthermore, ion implantation is normally automatically considered as having a geometry where the accelerated ion beam addresses the sample through a flat surface. It cannot handle samples of random and various shapes in a sensible way.

SUMMARY OF THE INVENTION

According to the invention, a method of producing carbon with electrically active sites includes the steps of providing a source of carbon and exposing that source to irradiation of an energy suitable to cause the photonuclear transmutation of some of the carbon atoms into boron.

The carbon source may be any allotrope of carbon including diamond, diamond-like materials, amorphous carbon, graphite, carbon nanostructures or fullerenes. The invention provides a method of producing a population of electrically active sites, some of which will be substitutional when the carbon has a crystalline structure, by the homogeneous photonuclear transmutation of some of the carbon atoms into boron. The transmutation may be assisted and enhanced if appropriate by one or more of a selection of annealing regimes: thermal heating and/or electron beam heating or any other form of specimen-specific heating, either post-irradiation or during irradiation; laser irradiation again either post irradiation or during irradiation, assisted if necessary simultaneously by thermal or electron beam heating; laser illumination at specifically selected wavelengths and/or of wavelength bands, again either post-irradiation or during irradiation or both, assisted if necessary by sample heating of thermal or electron beam origin or other means: including the concept of resonant effects in the annealing process including specifically resonant laser annealing at room or elevated temperatures, including also specifically combinations of temperature protocols such as low temperature irradiation followed by rapid thermal annealing.

The invention has particular application to the controlled and homogeneous doping of diamonds of all types, shapes and sizes, single crystal and polycrystalline, natural and synthetic. The synthetic diamond may be produced by high pressure/high temperature growth or chemical vapour deposition.

The irradiation will preferably be achieved using photons, and particularly gamma rays, but may also be achieved by using other irradiation sources such as electrons.

The interaction of photons with matter is a gentle one in so far as radiation damage is concerned in comparison with that of charged particles or neutrons. This interaction takes place through the mechanisms of the photoelectric effect, of Compton scattering, and of pair production. It is important to note that all three of these mechanisms are electromagnetic in origin, rather than operating through the nuclear interaction. Hence the disruption to the ordered crystal lattice is minimal, and particularly so as compared with that caused inherently by charged particles or neutrons.

Where radiation damage is caused, for example by an energetic proton or neutron and a recoiling boron being produced, such damage may be reduced by use of one or other of the annealing methods described above. Photons have a high penetrating power as compared with all other typical radiations, hence lending themselves to an extremely high degree of homogeneity in any effects which they produce.

It is important that the energy of the radiation is chosen so that the desired photonuclear reaction leading to the formation of boron is achieved. The minimum energy of the radiation necessary to achieve a particular photonuclear reaction will vary according to the specific energetics of the reaction. Examples are provided hereinafter. Typically, the energy of the radiation will be in the range 16 MeV to 32 MeV.

It is further preferred that the energy of the radiation is chosen to excite the giant dipole resonance (GDR) which leads to an enhancement of the boron production rate. The GDR is a broad resonance and bremsstrahlung can be produced by means of an electron accelerator such that the endpoint energy of the bremsstrahlung spectrum is above the region of the GDR providing thereby photons in the relevant energy range to excite the GDR. Certain advantages may be achieved by the use of monoenergetic (monochromatic) photons of selected energy, or by a defined window of photon energies of chosen energy width and median energy.

The photonuclear reaction can be employed to effect the transmutation of carbon atoms to boron atoms with complete control of the number of boron atoms produced. Doping concentrations of a few parts of boron per million carbon atoms, can be achieved with the ability of producing smaller or larger dopant concentrations.

DESCRIPTION OF EMBODIMENTS

Figure 1:
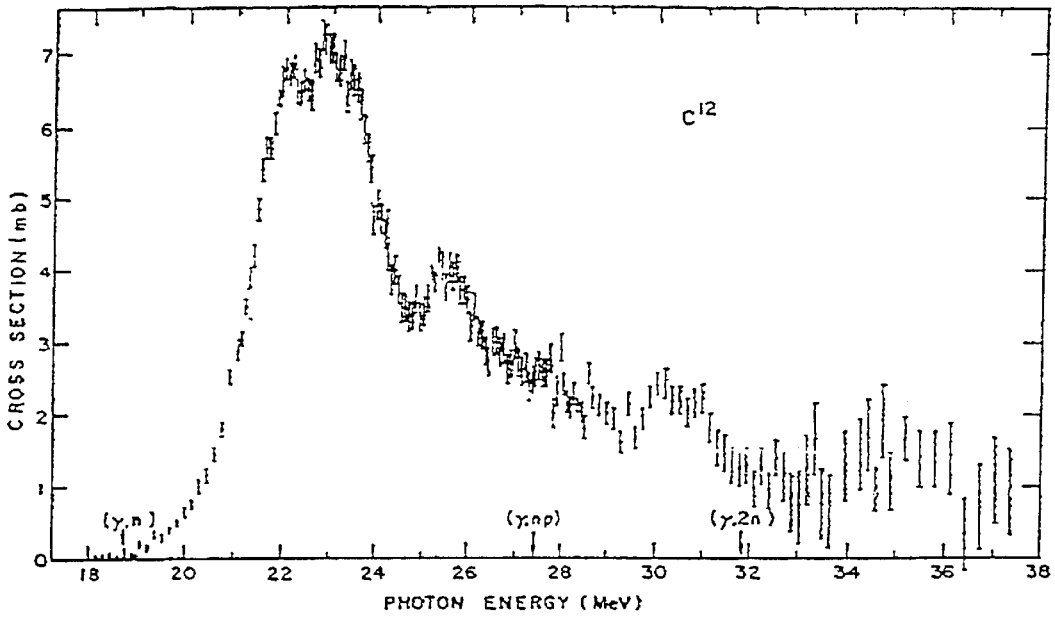
FIG. 1 is a graph of the photonuclear excitation function for carbon (photoneutron-cross-section data for carbon [$\sigma(\gamma, n)+\sigma(\gamma,np)$] obtained by the use of monochromatic photons, and measurements of the total neutron yield) showing the enhanced cross section in the giant dipole resonance (GDR) region.

A specific mechanism for producing p-type conductivity (through boron production/doping, for example) is that of the use of photonuclear reactions, starting with $^{12}C\ (\gamma,p)^{11}B$ with Q=−15.9572 MeV (1)

and $^{12}C\ (\gamma,n)^{11}C$ with Q=−18.7215 MeV $^{11}C \rightarrow \beta^{+}+^{11}B(\tau=20\ m)$ with Q=+1.982 MeV (2)

Also to be considered, arising from the small amount (~1%) of $^{13}C$ in natural carbon, are $^{13}C\ (\gamma,p)^{12}B$ with Q=−17.533 MeV $^{12}B \rightarrow \beta+^{12}C\ (\tau=20.2\ ms)$ with Q=+13.369 MeV (3)

and $^{13}C\ (\gamma, n)^{12}C$ with Q=−4.947 MeV

The end-products arising from these primary and most prolific of the photonuclear reactions in diamond are the p-type dopant boron-11 (for the dominant isotope carbon-12) and for the minor isotope (carbon -13) the stable isotope carbon-12 itself. It should be appreciated that the photon-induced recoils of the residual nuclei are short-ranged and will generally come to rest in the sample, and the proton or neutron produced will also interact with the matrix. These energy loss situations are familiar, and some annealing may be indicated, either self-annealing or sample heating during or post-irradiation or a combination of both, or one of the temperature sequencing protocols such as irradiation at low temperatures followed by rapid thermal annealing (Ref. Sandu et al. App. Phys Lett. 55 (1989) 1397). These thermal annealing procedures may be combined with (simultaneous) laser irradiation where the wavelengths of the laser irradiation are specifically selected and resonance effects with the carbon crystal structure (e.g. the diamond lattice) may be invoked. Using these methods a high and well-controlled degree of substitution of the boron atoms in the carbon crystal sample can be produced, with a remarkable degree of homogeneity of the distribution of boron throughout the carbon sample, whether in single crystal, polycrystalline or amorphous form.

These photonuclear reactions are generally strongly endothermic.

Thus, if irradiation with photons of, say, 5 to 6 MeV, were to be used, both the (γ,p) and (γ,n) channels for carbon-12 are closed. Similarly, if a photon energy of 16 MeV is chosen, it is above threshold for the $^{12}C\ (\gamma,p)\ ^{11}B$ reaction so that the channel is open, while it is still below threshold for the $^{12}C\ (\gamma,n)\ ^{11}C$ reaction so that this channel is still closed to production.

Considering the two carbon isotopes alone, the following additional but less likely or weaker photonuclear reactions arise from the irradiation of carbon with photons:

$^{12}C\ (\gamma,d)\ ^{10}B$ (stable) Q=−25.187 MeV (5)

$^{12}C\ (\gamma,np)\ ^{10}B$ (stable) Q=−27.412 MeV (6)

$^{12}C\ (\gamma,2n)\ ^{10}C$ Q=−31.806 MeV $^{10}C \rightarrow \beta^{+}+^{10}B\ (\tau=19.5\ s)$ Q=+3.611 MeV (7)

$^{12}C\ (\gamma,t)\ ^{9}B$ Q=−27.3696 MeV $^{9}B \rightarrow ^{8}Be+p$ Q=+0.187 MeV $^{8}Be \rightarrow \alpha+\alpha$ Q=+0.094 MeV (8)

$^{12}C\ (\gamma,^{3}He)\ ^{9}Be$ (stable) Q=−26.281 MeV (9)

$^{12}C\ (\gamma,^{4}He)\ ^{8}Be$ Q=−7.3696 MeV $^{8}Be \rightarrow \alpha+\alpha$ Q=+0.094 MeV (10)

$^{12}C\ (\gamma,^{5}He)\ ^{7}Be$ Q=−27.222 MeV $^{7}Be \rightarrow \epsilon+^{7}Li$ Q=+0.861 MeV (11)

or equivalently and perhaps more likely $^{12}C\ (\gamma,^{1}H+^{4}He)^{7}Li$ Q=−24.6 MeV (12)

(which reaction has been experimentally observed, along with the other 3-body reactions)

$^{14}N\ (\gamma,^{1}H+^{4}He)^{9}Be$ Q=−18.2 MeV $^{16}O\ (\gamma,^{1}H+^{4}He)^{11}Be$ Q=−23.2 MeV The following should be noted in regard to the secondary photonuclear reactions induced in the major isotope carbon - 12:

in two channels p-type dopant boron-10 is produced;

in another two channels alpha-particles are produced;

in another channel the stable isotope beryllium-9 is produced;

and in the two channels the stable isotope lithium-7 is produced.

These secondary reactions must be expected to have low cross sections.

The selection of photon energies is now considered. Common to all nuclei, is the characteristic that the total photonuclear absorption cross section, as a function of incident photon energy, shows a very large maximum, some 2 to 3 MeV wide, with a smooth A-dependence (A=mass number of nucleus) which (based on a simple harmonic oscillator model) goes as $$E_{max}=42A^{-1/3}MeV$$

which crudely predicts a resonance close to 20 MeV photon energy. More sophisticated treatments of the data (Ref. Berman et al. Rev Mod Phys 47 (1975) 713) suggest for a two-component fit $$E_{max}=47.9A^{-1/4.27}MeV$$

which predicts a resonance at 26.7 MeV, or even for a three-component fit $$E_{max}=77.9A^{-1/3}(1-e^{-A/238})+35.4A^{-1/16}e^{-A/238}$$

which predicts a resonance at 22.8 MeV.

Experimentally measured values for carbon-12 are close to this, viz $$E_{max}\approx 22.5\ \text{MeV for the } (\gamma,n) \text{ reaction}$$

and $$E_{max}\approx 21.5\ \text{MeV for the } (\gamma,p) \text{ reaction}$$

This dominant resonance has been shown to be dipole in character and is termed quite appropriately as the "giant dipole resonance (GDR)". It may be simply understood as a fundamental resonance mode for all nuclei, with picturesquely the protons and the neutrons in the nucleus oscillating against one another. In the attached graph, FIG. 1, the photonuclear excitation function (cross section as a function of incident energy) is presented covering the GDR region and beyond. It is evident that there is a major advantage in production yield to be gained by operating in the GDR region, provided of course the energy of the radiation is above the threshold energy for the reaction in question, and may indeed be kept below that of some undesirable reactions.

The threshold energies for the photonuclear reactions described above are:

Reaction (1) 15.957 MeV

Reaction (2) 18.722 MeV

Reaction (3) 17.533 MeV

Reaction (4) 4.947 MeV

Reaction (5) 25.187 MeV

Reaction (6) 27.412 MeV

Reaction (7) 31.806 MeV

Reaction (8) 27.370 MeV

Reaction (9) 26.281 MeV

Reaction (10) 7.370 MeV

Reaction (11) 27.222 MeV

Reaction (12) 24.6 MeV

At the GDR of ~22.5 MeV there are the two primary [viz. (γ,p) and (γ,n)] channels accounting for most of the dipole strength open as boron-producing reactions. Using a bremsstrahlung photon spectrum with its continuous characteristic, an energy maximum of say 32 MeV would open 5 boron-producing reaction channels. It should be noted, however, that the GDR is as much as some few-MeV broad, so that there is this generous latitude which can be used to advantage. The decay of the giant dipole excited carbon-12 nucleus can be expected to proceed as per the characteristics of the nuclear statistical model so that the simple neutron and proton decay channels may be expected to dominate, and account for most of the strength.

It is possible to produce monochromatic photons or photons in an energy window of finite width and selected median energy, and this may be used to advantage. One such situation would be to reduce the radiation damage to the carbon crystal by using only photons with energy in the GDR region, in other words eliminating photons that contribute only in a small way to the chosen photonuclear yield, but which nevertheless contribute to the radiation damage. Monochromatic photons can be produced by a number of established techniques, including by positron annihilation-in-flight and by the accelerator-produced photon source through the capture reaction $^{3}H(p,\gamma)^{4}He$ with Q=+19.812 MeV.

Diamond can contain elemental defects, the most common of which are hydrogen, nitrogen and oxygen. While hydrogen plays a role of singular importance in the growth of diamond and in the properties of diamond, it plays no ostensible role in the sense of photonuclear transmutation reactions, other than in the case of the minor isotope of hydrogen (deuterium). The major elemental defects that are characteristic of diamond, namely the light volatiles hydrogen, nitrogen and oxygen do not present any problems in the transmutation doping of carbon by photonuclear reactions.

The other characteristic defects in diamond, viz, structural defects, have no specific interactions with incident photons.

The boron production in diamond through photonuclear reactions specifically in the GDR region may be quantified. This aspect can be divided into well-defined stages:

first, there is the bremsstrahlung production stage, which reveals the flux of photons relevant to the GDR irradiation region which is available.

second, there is the photonuclear reaction stage which enables the calculation of the production characteristics for the elements of interest. In this regard the question of the penetrability of diamond to photons of energy in the GDR region is relevant.

Stage 1:

Bremsstrahlung production

Figure 2:
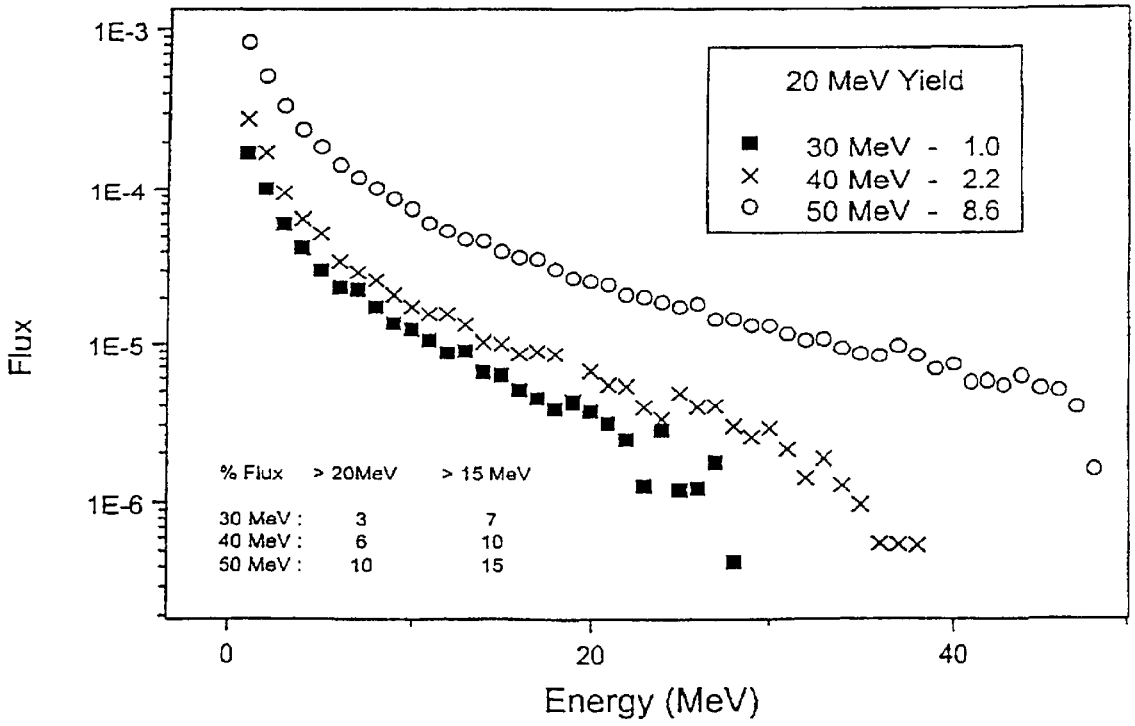
FIG. 2 is a graph showing the bremsstrahlung spectra at three different electron energies.
Figure 3:
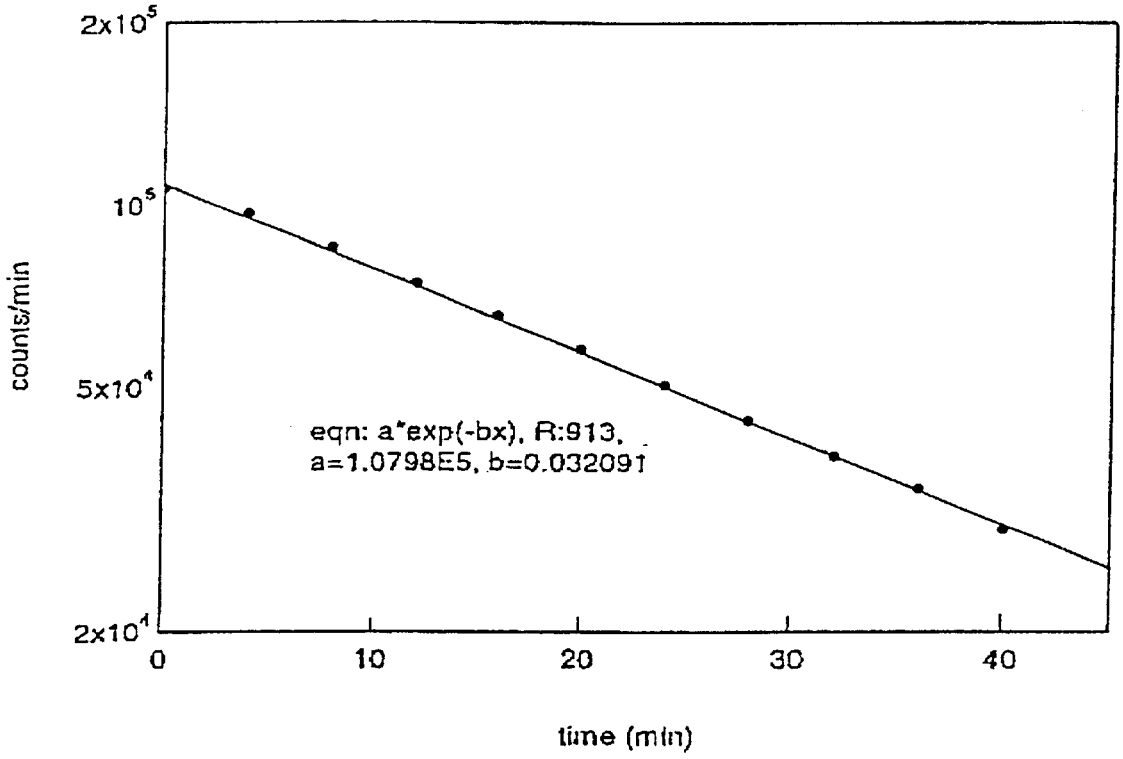
FIG. 3 is a decay curve confirming formation of boron-11.

It is necessary to know the flux of photons in the GDR region of interest in the bremsstrahlung spectrum produced in a target by monoenergetic electrons of selected energy. The shape of the bremsstrahlung spectrum is a steeply decreasing function with increasing photon energy, with zero photon flux at the end point (maximum) energy which is equal to the energy of the incident electron beam. This is a complex calculation. The calculated trends and the comparison for three different electron energies are shown in FIG. 2. The selection of incident electron energy is influenced by the need for enhanced yield in the GDR region which suggests going to higher electron energies but this has as a consequence a greater flux of photons that do not contribute to the GDR and which contribute to the photonuclear cross section in only a minor way consistent with the small non-GDR cross section, but which add unnecessarily to the radiation damage. Measurements have been made on two electron microtron accelerators at electron energies of 30, 40, 50 and 100 MeV. At each of these energies unambiguous 20 minute halflife activity (e.g. see FIG. 3) was detected in two-photon positron annihilation signals, corresponding uniquely to the decay of carbon-11 which had been produced in the reaction $^{12}C(\gamma,n)^{11}C$. This is clear proof of boron production. The photon flux as assessed from such measurements is consistent with the calculated flux. A typical flux as determined for the case of 100 MeV incident electrons, was $0{,}3\times10^{10}$ photons/cm$^2$/sec.

Stage 2:

Photonuclear reactions

The two reactions in consideration are $$^{12}C+\gamma->^{11}B+p$$

and $$^{12}C+\gamma->^{11}C+n$$

More generally:

$$A+x->B+y$$

The formation rate of a specific nuclide, B, is as follows:

$$dN_B/dt=\phi\sigma N_A$$

where $\phi$=flux density of the photons (x) in cm$^{-2}$s$^{-1}$ $\sigma$=cross section in cm$^2$ $N_A$=number of atoms of A in the volume sampled by the photon beam Integrating this equation, knowing the photon flux density, the cross section and the density of the carbon compound, one can determine the number of boron atoms produced in a determined time.

If, in addition, the product nuclide formed, B, is radioactively unstable, then $$-dN_B/dt=\lambda N_B$$

where $$\lambda=\text{decay constant}$$

Hence the net production rate of B will then be $$dN_B/dt=\phi\sigma N_A-\lambda N_B$$

Integrating gives $$N_B=[\phi\sigma N_A/\lambda]-(1-e^{\lambda t})$$

Hence the activity of B as a function of time is $$A=-dN_B/dt=\lambda N_B=\phi\sigma N_A(1-e^{-\lambda t})\ (1-e^{-\lambda t})=\text{saturation factor}$$

From the measurement of the activity at a known time, the actual number of atoms of the nuclide B formed can be independently determined.

The results obtained from the formation determination and from the decay measurements are found to be consistent with one another. A typical result for an irradiation of 1 hour, in a diamond crystal, gives ~0,01 ppm (atomic) boron. Considering that this was for a modest electron beam current, and a scanned beam, with a low duty cycle electron beam, it can be concluded that few-ppm boron production is readily achievable.

This doping will be extremely homogeneous, since if the mass attenuation coefficient is considered:

$\mu/\rho=0.015\ cm^2/g$ for $E_y=25$ MeV in carbon $\rho=3.5\ g/cm^3$ for diamond thus $\mu_x=0.0525\ cm^{-1}$ $I=I_o e^{-\mu x}$ x=0.1 cm $I/I_o=0.99$ 2.5 cm 0.88

13.2 cm 0.50

Therefore, "normal" size diamond is transparent to 25 MeV gammas, ensuring homogeneous production of boron throughout the diamond.

The invention provides a number of advantages over known methods of producing carbon, particularly diamond, with dopants in electrically active sites. Some of these advantages and preferred ways of carrying out the invention are set out hereinafter:

- photonuclear reactions, specifically the (γ,n and/or p) channels which are the strongest channels, directed to carbon in all forms, but specifically diamond, lead to the transmutation of carbon into boron
- choosing the photon energy to excite the giant dipole resonance, leads to an enhancement of the boron production rate
- advantages may be achieved by the use of monoenergetic photons, or an energy band of chosen width and median energy
- boronation production at useful practical rates is readily achievable with state-of-the-art accelerator facilities
- it is a practical/industrial advantage of great significance that irradiation does not need to be carried out in vacuum (either accelerator vacuum or stand-alone specimen vacuum)
- the 20 minute halflife radioactivity which is an intrinsic feature of the photon induced transmutation doping of carbon, is used as a quantitative measure of the amount of boron produced, and serves as a measure to control the degree of boronation of the sample.
- annealing methods are known and may be used to deal with radiation damage: these include ohmic thermal heating during irradiation or post-irradiation or a combination of both; electron beam heating; combinations such as cold irradiation and rapid subsequent thermal annealing; laser irradiation during photon irradiation or post-photon irradiation, or a combination of both, with or without thermal heating in addition; laser irradiation of specifically selected wavelengths to achieve the advantage of resonant effects, inter alia.
- radiation damage prior to annealing, may be used to advantage in the provision of vacancy sites for filling by the (recoiling) boron atoms rendering them substitutional in the host lattice
- a high degree of substitutional boronation can be achieved in the case of diamond
- the degree or extent of boronation is readily controlled
- the high degree to which the boronation is uniform or homogeneous is an intrinsic feature of the method
- selected regions of the carbon/diamond can be boronated through collimation of the photons
- boronation patterns in the carbon/diamond sample can be achieved through the use of "writing" with milli- or micro-diametered electron beams: sub-micrometer diameter electron beams are achievable
- he boronation effects are not radiation damage effects but true transmutation effects, and cannot thus be annealed out or removed in any other manner—once boronated, the boronation is permanent
- p-type doping of diamond can be achieved on sample size scales from micro to macro, for sample numbers from small to very large, in a process which readily lends itself to industrial production
- photon irradiation is not limited to single samples; multiple suites of samples can be simultaneously irradiated
- effects similar to those achieved by photon irradiation can be achieved through the use of the reactions
  - $(e^-, e^-p)$
  - $(e^+, e^+p)$
  - $(e^-, e^-n)$
  - $(e^+, e^+n)$
  - $(\mu^-, \mu^-p)$
  - $(\mu^+, \mu^+p)$
  - $(\mu^-, \mu^-n)$
  - $(\mu^+, \mu^+n)$ but somewhat enhanced radiation damage must be expected.

Semi-conducting diamond produced by the method of the invention has particular application in the field of detectors.

The use of diamond as a detector of radiation has a long history, but has still not been realised routinely in practice. There are many chapters in this history, ranging from detectors with energy resolution of alpha, beta and other charged particles, to thermoluminescence detectors, to solid state (ionisation) detectors, to detectors made of CVD diamond, intended also as track indicating devices for the region in the immediate vicinity of the colliding beams in e.g. the new large hadron collider (LHC) at CERN, to detectors for use in medical (including dosimetry) applications where the tissue equivalence of diamond is an additional feature. The quest remains, everyone recognising the potential advantages of the remarkable physical properties of diamond, starting with its wide band gap.

The invention brings to this situation the ample provision of p-type doping of diamond, in single crystal and polycrystalline form, of diamond-like carbon and other allotropes of carbon, of both natural and synthetic manmade diamond (produced both by high pressure high temperature and by CVD techniques), all readily available through the photonuclear transmutation of carbon to boron, exploiting the high yield of the giant dipole resonance. In selected circumstances, thick or thin target bremsstrahlung can simply be used, in other cases monochromatic photons are better deployed, and in yet other circumstances a band of photon energies is best used.

Patterns of boronation can be produced for special applications of detectors or devices in general, either through collimation or through the use of micron-diameter electron/positron beams, with writing capability.

Various forms of detector and fields of application are, for example:

semi-conductor charged particle and electron detectors neutron detectors thermoluminescence detectors detectors and imaging devices in ultra-high energy and intense radiation field circumstances 1-dimensional and 2-dimensional position sensitive detectors ultra-low background detectors medical imaging and dosimetry detectors.

It has been observed that plasma-treated, boron doped diamond can show substantially improved secondary electron emission efficiencies over those of undoped diamond. Diamond is thus a very good alternative to metals as secondary electron emitters for many reasons including its strength which would make it far less prone to damage, and in the case of thin diamond films to tearing.

Very thin diamond films, boron doped and surface treated by the method of the invention, would make much superior positron thermalising moderators, and also low energy electron / positron "start" detectors.

What is claimed is:

1. A method of producing solid allotropic carbon with electrically active boron sites comprising the steps of:

providing a source of carbon, and exposing that source to irradiation of an energy suitable to cause the photonuclear transmutation of some of the carbon atoms into boron, the energy of irradiation being chosen to excite the giant dipole resonance (GDR) in the carbon.

2. A method according to claim 1 wherein the irradiation is achieved using photons.

3. A method according to claim 2 wherein the photons are gamma rays.

4. A method according to claim 1 wherein the irradiation is achieved using monoenergetic photons.

5. A method according to claim 1 wherein the irradiation is achieved using an energy band of photons of chosen width and median energy.

6. A method according to claim 1 wherein the energy of the irradiation is chosen to cause the transmutation of some of the carbon atoms into boron according to the photonuclear reaction:

$^{12}C\ (\gamma,p)^{11}B$.

7. A method according to claim 6 wherein the energy of the irradiation is chosen so that the photonuclear reaction $^{12}C\ (\gamma,p)\ ^{11}B$ is the dominant reaction.

8. A method according to claim 1 wherein the energy of the irradiation is chosen to cause the transmutation of some of the carbon atoms into boron according to the photonuclear reaction:

$^{12}C\ (\gamma,n)^{11}C$ $^{11}C \rightarrow \beta^{+} + ^{11}B$.

9. A method according to claim 1 wherein the energy of the radiation is in the range 16 MeV to 32 MeV.

10. A method according to claim 1 wherein the carbon source is selected from diamond, diamond-like materials, amorphous carbon, graphite, carbon nanostructures and fullerenes.

11. A method according to claim 1 wherein the carbon source is diamond.

12. A method according to claim 1, further comprising the step of annealing of the carbon after irradiation.

* * * * *